US005226664A

United States Patent [19]

Bodkin, Sr.

[11] Patent Number: 5,226,664

[45] Date of Patent: Jul. 13, 1993

[54] EASY TO SHUFFLE PLAYING CARDS

[76] Inventor: Lawrence E. Bodkin, Sr., P.O. Box 16482, 1149 Molokai Rd., Jacksonville, Fla. 32216

[21] Appl. No.: 902,380

[22] Filed: Jun. 23, 1992

[51] Int. Cl.[5] ..... A63F 1/02

[52] U.S. Cl. ..... 273/293

[58] Field of Search ..... 273/293, 294, 296, DIG. 27

[56] References Cited

U.S. PATENT DOCUMENTS

| | | | |
|---|---|---|---|
| Re. 7,756 | 6/1877 | Richardson | 273/294 |
| 326,678 | 9/1885 | Seedhouse | 273/293 X |
| 3,667,759 | 6/1972 | Barr | 273/293 X |

FOREIGN PATENT DOCUMENTS

| | | | |
|---|---|---|---|
| 9089 | 5/1891 | United Kingdom | 273/293 |
| 24741 | 11/1905 | United Kingdom | 273/293 |

OTHER PUBLICATIONS

Aids & Appliances, catalog of American Foundation for the Blind Jul. 1972–Jun. 1973 ed. pp. 2, 3, 6.

*Primary Examiner*—Paul E. Shapiro

[57] ABSTRACT

A simple aid to shuffling is incorporated into the structure of playing cards with no significant loss in quality of appearance or feel. A slightly raised area or pattern of such areas is provided on one side of each card in a deck to act as a fulcrum between cards. The deck is then "cut" or divided into two substantially equal parts, and the two parts of the deck are each held firmly at one edge. Each card becomes a lever and acting on the fulcrum areas causes the cards to spread apart at the opposite edges so that the parts of the deck can easily be slid into each other or interleaved, with cards from one part passing between cards in the other. While the deck is thus shuffled as effectively but more easily and with less card abuse than when more vigorous methods are used, the structure of the cards does not prevent the use of the other methods when they are preferred.

5 Claims, 2 Drawing Sheets

EASY TO SHUFFLE PLAYING CARDS

BACKGROUND OF THE INVENTION

The necessary shuffling of a deck of playing cards is accomplished in several ways by those who have the dexterity and have developed the skill, but many have disabilities caused by affliction, accident or merely age. Even those who are quite capable of clever hand manipulations have often wished that a simpler alternative were available, particularly if it could not only be more convenient but could offer values such as a reduction in the card abuse that many players impose by habitually over-bending the cards in their own versions of the more popular shuffling techniques.

Card shuffling mechanisms can be efficient and gentle, but are bulky and inconvenient to have on hand in every playing circumstance.

In accordance with the present invention, a simple aid to shuffling is incorporated into the construction of the cards. A slightly raised area or pattern of such areas is provided on either the back or face of each card, but in a substantially identical fashion within a given deck, to act as a fulcrum between cards. The deck is then "cut" or divided into two substantially equal parts and each resulting half of the deck is held firmly toward one edge. Each card then becomes a lever and acts on the raised fulcrum areas to spread their edges apart at the opposite edge so that one half-deck can be easily slipped into the other half or interleaved, with cards of one half-deck moving into position between cards of the other half-deck. The deck can thus be shuffled rapidly, with greater ease and just as effectively as with other methods, although the card structure does not prevent the use of the other methods in the event that they are preferred by some players.

Although the raised fulcrum areas may be placed on the front or back of the cards, specific aspects of the preferred embodiment include a pattern of slightly elevated card surfaces that can be made part of matching back designs in a deck and thereby avoid becoming a possible annoyance to those who would object to any change in the traditional appearance of the front, which they must continually observe.

Also included is the use of a single raised panel area which can continue the back design without appreciable interruption or, if made of a material applied after printing, be made transparent or with an open center to allow the design to show through.

One method allowing the fulcrums to be formed by embossing, includes a punch through method and another calls for a laminated card construction in which the embossed panel has its indented back sealed by a planar panel.

One simple method of producing the raised areas makes use of the thermographic printing process that causes printing to be notably raised above the surface. A fulcrum design can be thermographically printed over, and perhaps made to blend harmoniously with, a previously printed back design.

However formed, the elevation of these raised areas is slight and in general, limited to approximately one-half of the card thickness. The average playing card measures 0.010 to 0.011 inches in thickness and a fulcrum area, elevated 0.005 inches above the card surface, works quite well.

In accordance with this invention, the raised areas may be produced in various ways, and given varying configurations but they will have the same function, if they have similar elevation and spacing from the card edges.

While the spread between card edges is increased by having the raised fulcrum surfaces placed nearer the edges, placing them closer to the edges increases the possibility of holding over the fulcrum positions, which can cause the desired effect to be lost.

It is preferred that the raised surfaces rise gradually from the surrounding surface, rather than abruptly, whenever the construction method permits, to reduce any tendency to catch the edges of cards as they are being slid together to restore the deck.

A primary object of the invention is to include a means to aid in the shuffling of a deck of playing cards within the structure of the cards.

Another object is to make such a deck of cards in an economical manner, so that it can be made available in the price ranges commonly encountered for standard decks.

A particular object is to make such a deck available to those who find the conventional techniques for manual shuffling of playing cards difficult or impossible.

Still another object is to provide that the means to aid in shuffling does not interfere with the use of standard shuffling techniques, if a player prefers to employ them and has the ability.

A further object is to provide that the means to aid in shuffling does not create an objectionable alteration in the conventional playing card appearance.

A still further object is to include the means to aid in shuffling in a way that retains a substantially "normal" feel of the cards for the player.

BRIEF DESCRIPTION OF THE DRAWINGS

The invention, both as to its organization and principles of operation, together with further objects and advantages thereof, may be better understood by reference to the following detailed description of the embodiment of the invention, taken in conjunction with the accompanying drawings in which.

The advantage in a design with a continuous elevation in the direction of shuffling reassembly as shown in FIGS. 9 through 13, plus 15 and 16, is that it eliminates possible card edge contact with a second set of fulcrum edges as the cards are slid together.

Figure 17:
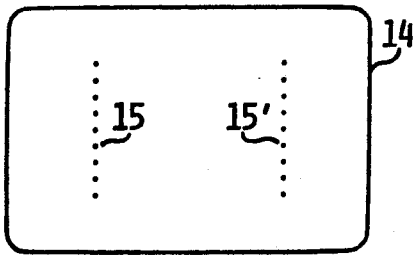
Figure 18:
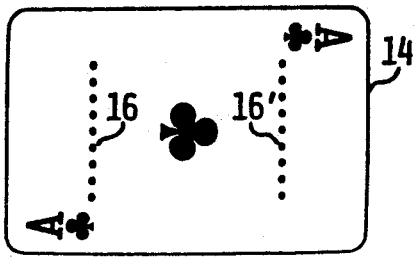

FIGS. 17 and 18 depict a card having two series of very small, embossed fulcrum elevations.

Figure 19:
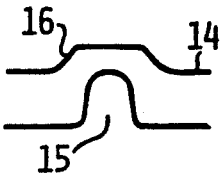
Figure 20:
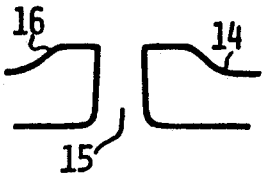

FIGS. 19 and 20 are cross sectional views of card 14 illustrating two special forms of small embossed elevations, made in accord with this invention.

DESCRIPTION OF THE PREFERRED EMBODIMENTS

Figure 1:
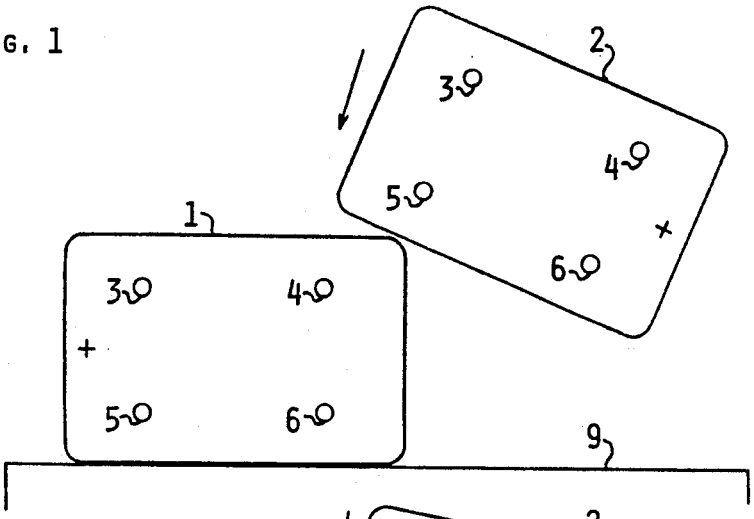
FIG. 1 depicts the back view of two divisions of a deck of playing cards in a position to be easily merged, in accordance with the shuffling process made possible by the present invention, each having the same pattern of small round, raised fulcrum surface areas.

Referring now to FIG. 1, two portions of a deck of playing cards 1 and 2, which may be presumed to be approximately equal halves of the deck, are shown in a back view and with normally decorated backs left plain, except for the raised areas 3, 4, 5 and 6 on each card, to avoid the confusion of unnecessary lines.

The two portions of the deck are shown in the position they would occupy just before the shuffling merger is begun. It will be noted that the merger technique shown here employs an efficient corner to near-corner "combing" contact rather than an end to end approach, because the latter displays a tendency to butt the ends of the cards against each other, particularly when the user cannot keep the contact edges of the two portions truly parallel.

The two portions of the deck are held, and pressure applied with the fingers, at the positions marked by the crosses. These positions are approximate and not particularly critical except that the pressure should be applied at an end, and toward the edge, since application of pressure over the fulcrum areas would eliminate the effect. The portion of the deck 1 is shown resting its edge on a table surface 9 and deck portion 2 is poised above it with its free end directed toward the free end of portion 1. While the portions may be merged when both are simply held in the hands, shuffling is generally done while seated at a playing table and a surface is readily available. The arrow indicates the direction of movement for the movable portion of the deck 2.

Figure 2:
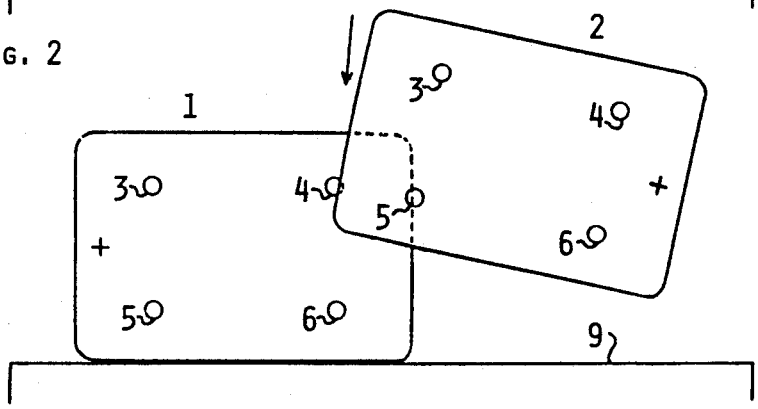
FIG. 2 depicts the same two portions of the deck as they have begun the merging stage of the shuffling process.
Figure 3:
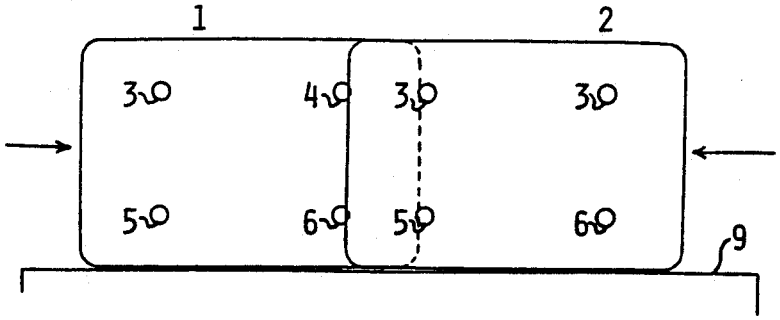
FIG. 3 depicts the completed merging that awaits the pushing together of the two portions, in the direction indicated by the arrows, that will reassemble the shuffled deck.

In FIG. 2 we see the same arrangement in which the indicated movement has succeeded in merging the corners of the deck portions and FIG. 3 shows the arrangement with deck portion 2 also resting against the table and the shuffling process finished except for pushing the two portions completely together to restore the deck. This is particularly easy when the table top support is used. The two parts of the deck can be held loosely and gently "patted" into each other with gentle end pressures.

While a single merger can result in a good shuffle, the ease and simplicity of the process, in accordance with this invention, permits several repetitions when desired with less than average delay.

Figure 4:
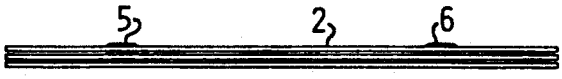
FIG. 4 is an edge view of a set of three adjacent cards, that illustrates the card separation in a deck when not being manipulated.

In FIG. 4, an edge view of three cards in the deck, shows the normal parallel separation of stacked cards with the separating fulcrum areas which simply add to the height or thickness of the deck.

As mentioned in the summary, playing card thickness is generally 0.010 to 0.011 inches and the serviceable elevation of raised fulcrum areas does not need to exceed 0.005 inches, so that the deck height increase may be expected to be as much as fifty percent. Both the thickness and relative thickness of the cards and raised fulcrum areas, in this figure and FIGS. 5 and 6 are exaggerated for drawing clarity.

Figure 5:
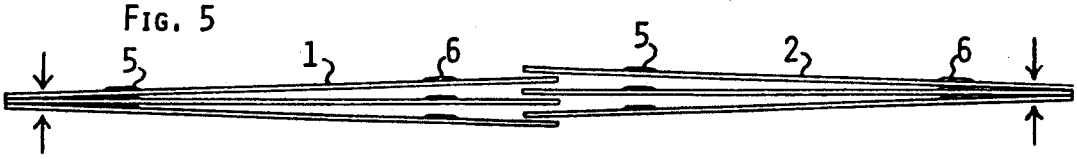
FIG. 5 is an edge view of two such sets of three cards each, as they would appear as parts of two divisions of a deck being held in readiness for merging.

In FIG. 5 we see the lever action of the cards in deck portions 1 and 2 as they act against the fulcrum areas nearest the point of applied pressure, indicated by the arrows, and the resulting increase in separation at the opposite edges that makes an easy shuffling merger possible. In this instance, visible fulcrum area 5, and cooperative concealed area 3, are responsible for the action, while visible area 6, and cooperative concealed area 4 would be responsible, if pressure were applied on the side nearest them.

Figure 6:
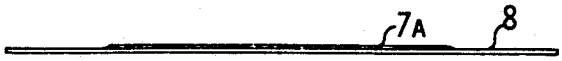
FIG. 6 is an edge view of a card in which a larger single raised area, such as that shown in FIG. 9, replaces the pattern of four smaller areas shown in FIGS. 1 through 5 and may also be considered representative of a side view of the cards depicted in FIGS. 10, 11, 12, 13, 15 and 16.
Figure 9:
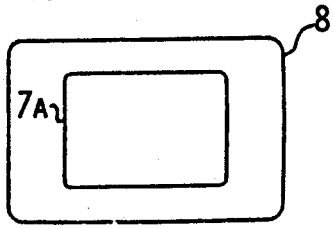
FIGS. 9 through 12 and 14 through 16, depict the back of a card 8, with a few of the various designs that can be raised from the surface to produce an aid to shuffling, in accordance with this invention.
Figure 10:
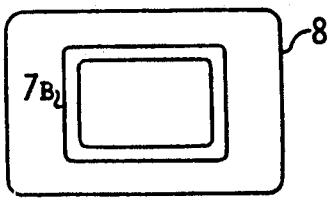
Figure 11:
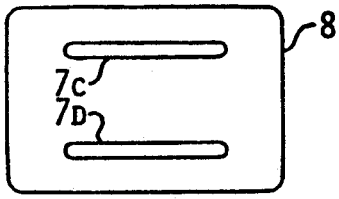
Figure 12:
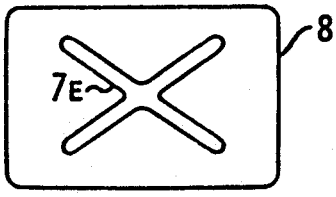
Figure 13:
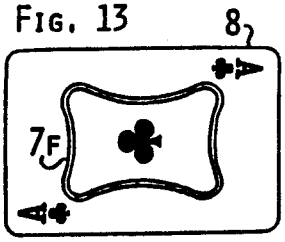
FIG. 13 shows an example of a design raised from the front surface. Although just as effective and also in accord with this invention, it is not usually considered preferable to placing raised fulcrum surface areas on the backs.

FIG. 6 shows an edge view of a card 8, also shown in FIG. 9, in which the pattern of four raised areas has been replaced by a working equivalent in the form of a single but larger raised area 7A. A possible disadvantage, in the use of a single, solid applied area, is that it may add considerably to card stiffness, but this is greatly dependent upon the nature of the material used. There are materials that have little rigidity, that would not make a substantial difference in the flexural quality of the card. The raised area may also be made as an outline, as in 7B, 7F, 7I and 7J respectively of FIGS. 10, 13, 15 and 16, have an irregular border as in 7E of FIG. 12, or there could be two moderate width elongated elevations as in 7C and 7D of FIG. 11.

Figure 7:
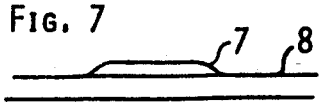
FIG. 7 is an enlarged side view of an elevated area such as those used in the pattern of four areas, shown in FIGS. 1 through 5 and FIG. 14.
Figure 14:
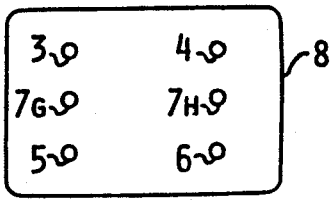
Figure 15:
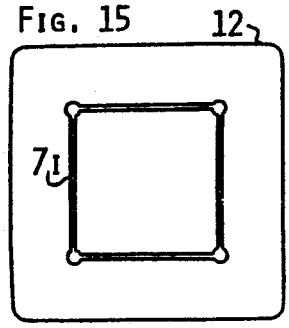
Figure 16:
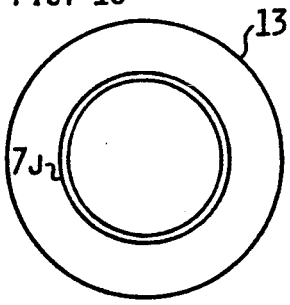

FIG. 7 is an enlarged cross sectional view of a small raised fulcrum like 3, 4, 5, or 6, used in the pattern of four, or 7G and 7H shown as added to the pattern in FIG. 14. It is shown with more representative proportioning in relative thickness of card and fulcrum than size limitations of FIGS. 4 and 5 would permit.

Raised areas may be formed by various methods, including the application of an adhesive secured planar element, a material in a plastic state, the raising of a printed area by a thermographic process and the embossing of an element in a laminated card.

Figure 8:
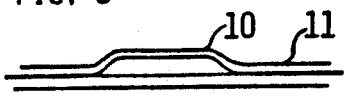
FIG. 8 is an enlarged cross sectional view of the elevated area shown in FIG. 7, if made by embossing and lamination.

FIG. 8 shows a cross sectional side view of a raised area like that of FIG. 7, as it would appear if the card were formed by lamination, with embossing of panel 11 to produce the raised area and with closing of the cavity on its reverse side by lamination with a planar panel to complete card construction.

It should be noted that playing cards of more unusual outline may also be modified in accord with the present invention, to include and benefit from the raised fulcrum areas that permit easy shuffling. Areas 7I and 7J are suggested configurations for elevated surfaces on the square and round cards 12 and 13 in FIGS. 15 and 16 respectively.

A special form of embossed fulcrum elevation, in accordance with this invention, is designed to prevent or minimize the objectionable entry of fulcrums of one card into the indentations on the reverse side of an adjacent card, that would occur with conventional embossing, as shown in FIGS. 19 and 20.

In any embossing, the projecting shape is larger than the inpressed shape, as determined by the thickness and compressibility of the embossed material. However, the amount of difference tends to be the same, regardless of size of the impressed shape and the percentage of difference therefore becomes greater and the effect more notable as the impressed shape decreases in size. Embossing of shapes having very small lateral dimensions is thus a part of preferred embodiments, which employ embossing, in accordance with this invention.

Playing card 14, shown in back view in FIG. 17, displays two rows of very small diameter embossing indentations shown as dots, and indicated by 15 and 15'. Corresponding rows of larger diameter fulcrum elevations, produced on the front of card 14, are shown in FIG. 18 as small circles and indicated by 16 and 16'.

Where the difference is great, the material of the projecting shape 16 or 16' may be modified by a die as in FIGS. 19 and 20, where the fulcrum design of card 14 has been given a plateau form that makes the upper surface of the elevation much larger than the die entry cavity 15 or 15' on its reverse side, and causes it to have a dissimilar shape. FIG. 20 shows a means of maximizing this principle that transfers substantially all material in the path of the male die to the formation of the plateau of the fulcrum by a female die, around the exit opening, as the male die is allowed to penetrate the card. However, the die used to form the cavity 15 in FIG. 20, should be sharply pointed and not have the rounded end used to shape the cavity 15 in FIG. 19.

While this invention has been described with respect to certain specific embodiments, it will be appreciated that many modifications and changes may be made by those skilled in the art without departing from the inventive concepts or spirit of the invention. It is intended therefore, by the appended claims, to cover all such modifications and changes as fall within the true spirit and scope of the invention.

What is claimed as new and what is desired to be secured by Letters Patent of the United States is:

1. In a deck of playing cards wherein each card is a substantially thin element having larger planar surfaces and having at least one smaller raised surface which is raised above one of said larger planar surfaces to facilitate shuffling of said deck and wherein said raised surface is produced by an embossing that also produces at least one impressed cavity in the other of said larger surfaces immediately opposite said raised surface, the improvement in which said raised surface is laterally larger and blunted in shape relative to the size and shape which would normally be dictated by the size and shape of said opposite cavity, to reduce the degree to which said raised surface of one card tends to enter said opposite cavity of an adjacent said card so that the effect of elevation of said raised surface is substantially maintained and so that resistance to sliding between said one and said adjacent cards is substantially avoided.

2. The playing cards as defined in claim 1 in which said raised surface and opposite cavity are so formed by reducing a lateral dimension of said embossing to the extent that card thickness becomes proportionately large enough to cause the raised surface of said embossing to become substantially larger than said opposite cavity in the direction of said lateral dimension.

3. The playing cards as defined in claim 1 in which the said raised surface is distorted relative to the shape of the cavity by a less than normal vertical displacement and greater than normal lateral displacement of card material so that a lateral dimension of said raised surface may be made to further exceed the corresponding dimension of the said cavity.

4. The playing cards as defined in claim 3 in which the said cavity comprises a penetration of said card to increase the amount of material available for said greater than normal lateral displacement.

5. The playing cards as defined in claim 1 in which said raised surface and said opposite cavity are so formed as to have a dissimilar shape.

* * * * *